US011142949B2

(12) United States Patent
Leng

(10) Patent No.: US 11,142,949 B2
(45) Date of Patent: Oct. 12, 2021

(54) RETRACTABLE LADDER

(71) Applicant: NEW-TEC INTEGRATION (XIAMEN) CO., LTD., Fujian (CN)

(72) Inventor: Luhao Leng, Fujian (CN)

(73) Assignee: NEW-TEC INTEGRATION (XIAMEN) CO., LTD., Fujian (CN)

( * ) Notice: Subject to any disclaimer, the term of this patent is extended or adjusted under 35 U.S.C. 154(b) by 138 days.

(21) Appl. No.: 16/096,570

(22) PCT Filed: Apr. 26, 2017

(86) PCT No.: PCT/CN2017/082013
§ 371 (c)(1),
(2) Date: Oct. 25, 2018

(87) PCT Pub. No.: WO2017/190615
PCT Pub. Date: Nov. 9, 2017

(65) Prior Publication Data

US 2019/0136620 A1 May 9, 2019

(30) Foreign Application Priority Data

May 3, 2016 (CN) ..... 201620388810.3

(51) Int. Cl.
*E06C 1/12* (2006.01)
*E06C 7/08* (2006.01)
*E06C 7/42* (2006.01)

(52) U.S. Cl.
CPC ..... *E06C 1/125* (2013.01); *E06C 1/12* (2013.01); *E06C 7/082* (2013.01); *E06C 7/42* (2013.01)

(58) Field of Classification Search
CPC . E06C 1/12; E06C 1/125; E06C 7/082; E06C 7/42; E04G 5/08
See application file for complete search history.

(56) References Cited

U.S. PATENT DOCUMENTS 2,037,860 A * 4/1936 Hummel ..... E06C 1/12 182/207
2,040,977 A * 5/1936 Carbis ..... E06C 1/12 182/207
2,147,370 A * 2/1939 Hummel ..... E06C 1/12 182/207
2,228,525 A * 1/1941 Lundskow ..... E06C 1/12 182/106

(Continued)

FOREIGN PATENT DOCUMENTS

CN 2811534 Y 8/2006
CN 200971748 Y 11/2007

(Continued)

*Primary Examiner* — Colleen M Chavchavadze
(74) *Attorney, Agent, or Firm* — Cooper Legal Group, LLC

(57) ABSTRACT

A stretchable ladder, having inner leg bar and outer leg bar, the side edge of the outer leg bar forming an opening. The outer leg bar is sleeved on the inner leg bar, with the inner leg bar and the outer leg bar being relatively slidable. The ladder has a lock structure for locking the inner leg bar and for preventing the inner leg bar from separating from the outer leg bar. The lock structure is disposed at the outer leg bar, and is hookable to the inner leg bar, so as to make the inner leg bar embedded in the outer leg bar.

10 Claims, 4 Drawing Sheets

(56) References Cited

U.S. PATENT DOCUMENTS 2,485,165 A * 10/1949 Pollman ..... E04G 1/152 182/223
2,588,959 A * 3/1952 Campbell ..... B66B 9/187 182/103
2,959,245 A * 11/1960 O'Keefe ..... E06C 1/12 182/151
3,237,719 A * 3/1966 Russell ..... E06C 7/16 182/103
3,282,378 A * 11/1966 Pierce ..... E04G 3/30 182/113
3,291,258 A * 12/1966 Twilley ..... E06C 1/12 182/211
3,556,254 A * 1/1971 Lambert ..... E04G 5/08 182/223
3,692,143 A * 9/1972 Kummerlin ..... E06C 1/12 182/24
4,802,643 A * 2/1989 Uys ..... H02G 3/0456 182/228.6
5,062,499 A * 11/1991 Tu ..... E06C 1/125 182/166
5,349,795 A * 9/1994 French ..... E04F 11/022 52/183
5,350,038 A * 9/1994 Lazarus ..... E06C 1/12 182/163
5,758,745 A * 6/1998 Beggs ..... E06C 1/12 182/207
5,845,744 A 12/1998 Beck et al.
6,269,909 B1 * 8/2001 Grimes ..... E06C 1/12 182/129
6,505,707 B1 * 1/2003 Berry ..... A01M 31/025 182/116
6,866,117 B2 * 3/2005 Moss ..... E06C 1/32 182/167
7,086,499 B2 * 8/2006 Moss ..... E06C 1/32 182/167
2015/0376946 A1 * 12/2015 Kurzer ..... B29C 65/70 182/194
2016/0123079 A1 * 5/2016 Ballard ..... E06C 7/46 182/207
2020/0040656 A1 * 2/2020 Mora ..... E06C 7/06

FOREIGN PATENT DOCUMENTS

CN 200996264 Y 12/2007
CN 205713939 U 11/2016
JP 2004218355 A 8/2004

* cited by examiner

RETRACTABLE LADDER

TECHNICAL FIELD

The present invention relates to a stretchable ladder, particularly to a support leg of a ladder.

BACKGROUND OF THE INVENTION

A stretchable ladder comprises two inner legs, an inner cross bar connecting the two inner leg bars, two outer leg bars, an outer cross bar connecting the two outer leg bars; the outer leg is sleeved on the inner leg, the inner leg is slidable with respect to the outer leg to achieve stretching function. The inner leg and the outer leg are slidable relatively, the reason that they don't separate from each other is the outer cross bar, that is to say, the outer cross bar pulls the two outer legs at the same time. Once the outer leg and the outer cross bar loose, the inner leg and the outer leg will separate. Therefore, the connecting of the inner leg and the outer leg of existing stretchable ladder is not stable and reliable. The connecting of the outer leg and the outer cross bar should be strong enough, otherwise they separate. In another word, the structure of the ladder needs to improve.

SUMMARY OF THE INVENTION

The present invention is provided with a stretchable ladder, which overcomes the disadvantages of the existing known technology. The technical proposal of the present invention is that:

A stretchable ladder, comprising inner leg bar and outer leg bar, the inner leg bar is a closed frame, the outer leg bar comprises a bottom plate and two side plates, two side plates are symmetrically disposed at the two ends of the bottom plate, the section of the outer leg bar is [ shaped or the extending of the shape, the side edge of the outer leg bar forms an opening; the outer leg bar is sleeved on the inner leg bar, the inner leg bar and the outer leg bar are relatively slidable, wherein further comprising a lock structure used to lock the inner leg bar and to prevent the inner leg bar separating from the outer leg bar, the lock structure is disposed in the outer leg bar.

In another preferred embodiment, the lock structure comprises a guiding block and a sliding groove, the guiding block is disposed at the inner side face of the side plate, the external surface of the inner leg bar is disposed with the sliding groove, the guiding block is slidably disposed in the sliding groove.

In another preferred embodiment, it comprises two guiding blocks symmetrically disposed at the two side plates.

In another preferred embodiment, the lock structure comprises a stop plate, the stop plate is disposed at the end of the side plate away from the bottom plate.

In another preferred embodiment, the lock structure comprises a lock hook, the lock hook is disposed at the inner side of the bottom plate, the inner leg bar is disposed with a curve hook, the lock hook is slidably locked to the curve hook.

In another preferred embodiment, it comprises two lock hooks.

In another preferred embodiment, the lock structure and the outer leg bar are integrally formed; the inner leg bar is a closed hollow tube.

Compared to the existing known technology, the technical proposal of the present invention has advantages as follows:

The lock structure is disposed at the outer leg bar, the lock structure can hook the inner leg bar, making the inner leg bar embedded in the outer leg bar, thus reducing the risk of the inner leg bar and the outer leg bar separating from each other, thus improving the stability of the ladder. In the case of same safety factor, the welding area of the outer leg bar and the cross bar can be reduced, thus reducing the welding cost.

BRIEF DESCRIPTION OF THE DRAWINGS

The present invention will be further described in accordance with the drawings and the embodiments.

DETAILED DESCRIPTION OF THE EMBODIMENTS

The First Embodiment

Figure 1:
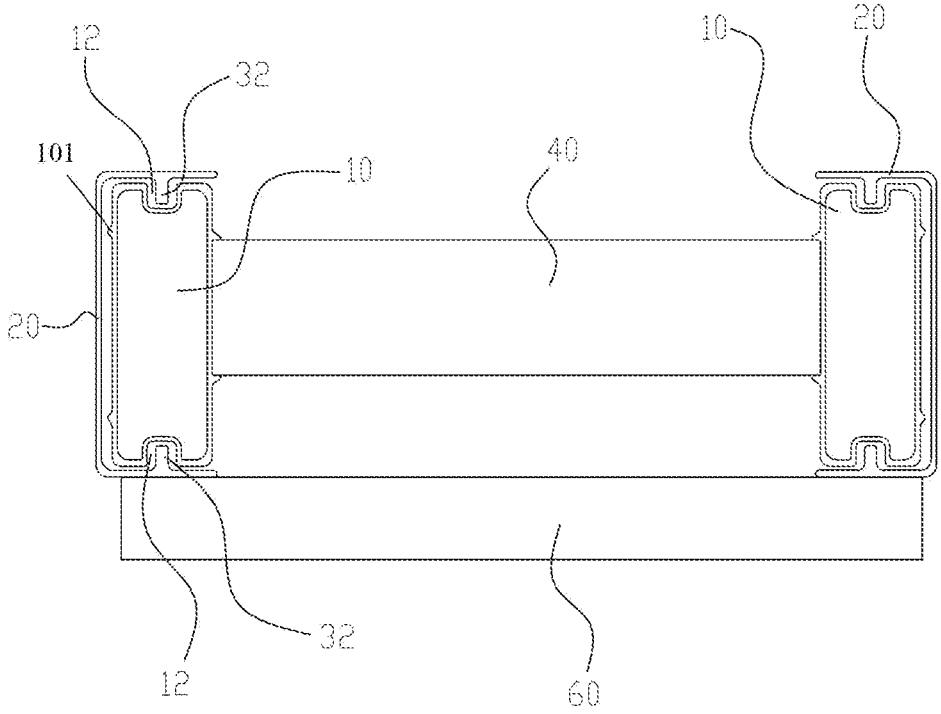
FIG. 1 illustrates a sectional diagram of a stretchable leg of a stretchable ladder of a first embodiment.
Figure 2:
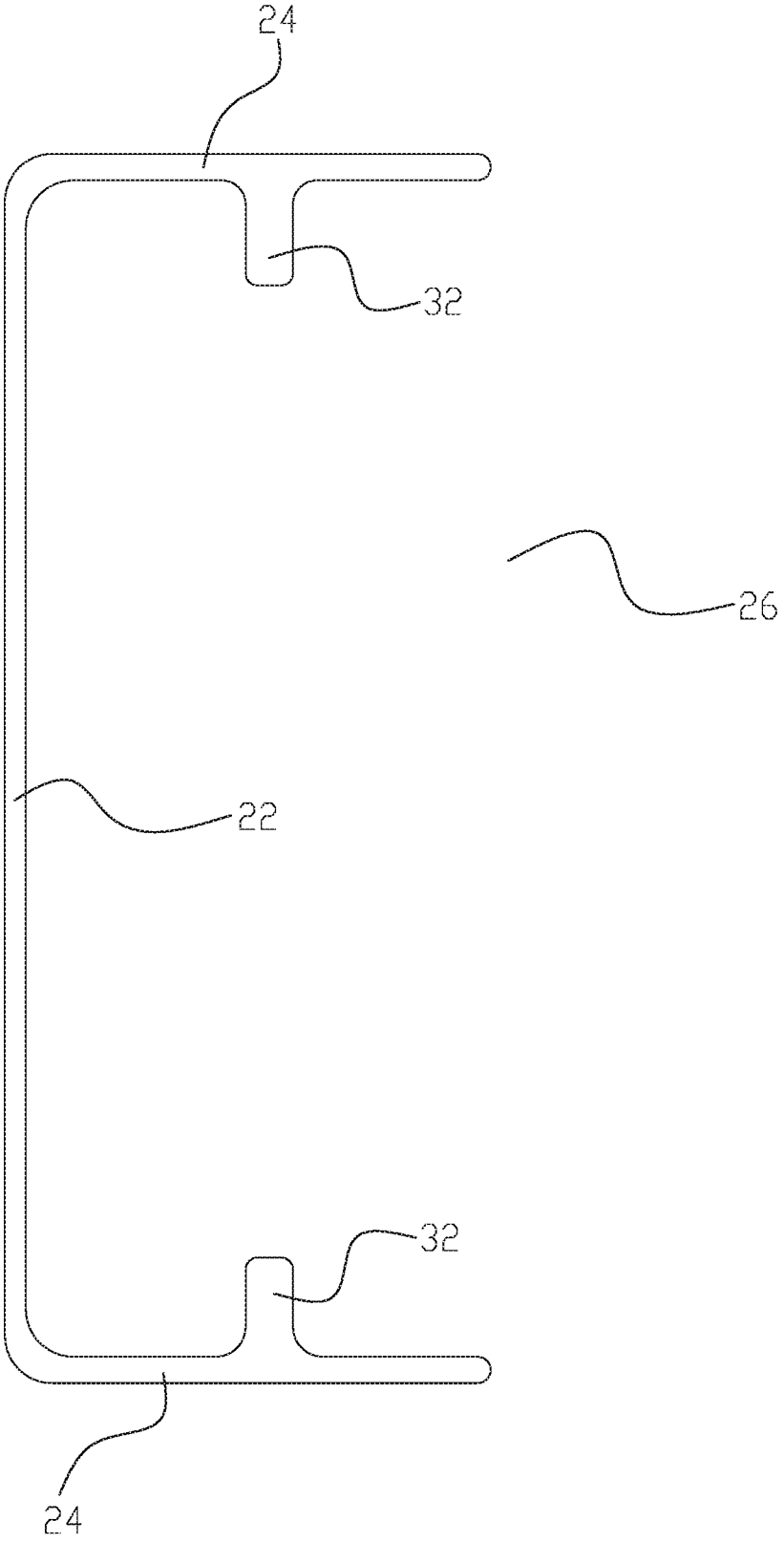
FIG. 2 illustrates a schematic diagram of an outer leg bar of a stretchable ladder of the present invention.

Please referring to FIG. 1 and FIG. 2, the stretchable ladder comprises two inner leg bars 10, an inner cross bar 40 connecting the two inner leg bars 10, two outer leg bars 20, an outer cross bar 60 connecting the two outer leg bars 20; the two outer leg bars 20 are respectively slidably connected to the two inner leg bars 10. The stretchable leg of the stretchable ladder of the present invention comprises the inner leg bar 10 and the outer leg bar 20. The section of the outer leg bar 20 is [ shaped, the outer leg bar 20 comprises a bottom plate 22 and two side plates 24, two side plates 24 are symmetrically disposed at the two ends of the bottom plate 22, the side edge of the outer leg bar forms an opening 26. The inner leg bar 10 is a closed hollow tube. The outer leg bar 20 is sleeved on the inner leg bar 10, the inner leg bar 10 and the outer leg bar 20 can slide relatively.

This embodiment further comprises a lock structure disposed at the outer leg bar 20 used to lock the inner leg bar 10 and to prevent the inner leg bar 10 separating from the outer leg bar 20 along the opening 26. The lock structure and the outer leg bar 20 are integrally formed.

The lock structure comprises two guiding blocks 32 symmetrically disposed at the inner side face of the two side plates 24. The external surface of the inner leg bar 10 is disposed with a sliding groove 12, and the guiding block 32 is slidably disposed in the sliding groove 12. The outer side of the inner leg bar 40 comprises a protrusion 101 extending into the clearance and facing the bottom plate 22.

The Second Embodiment

Figure 3:
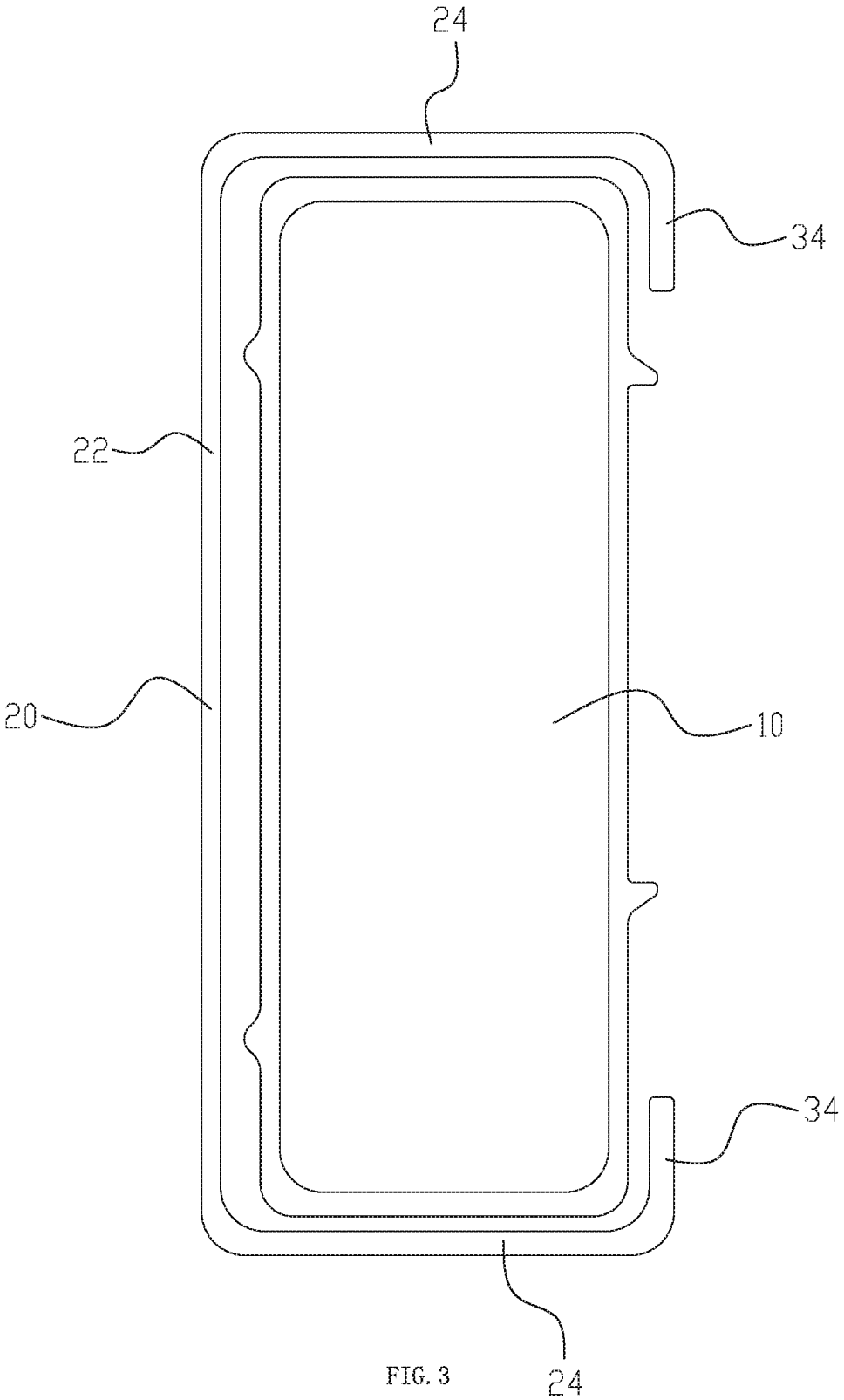
FIG. 3 illustrates a sectional diagram of a stretchable leg of a stretchable ladder of a second embodiment.

Referring to FIG. 3, this embodiment differs from the first embodiment in that: the lock structure comprises two stop plate 34, the stop plates 34 are respectively disposed at the two side plates 24. The stop plate 34 is disposed at the end of the side plate 24 away from the bottom plate 22. The cross section of the outer leg bar 20 is C shaped.

The Third Embodiment

Figure 4:
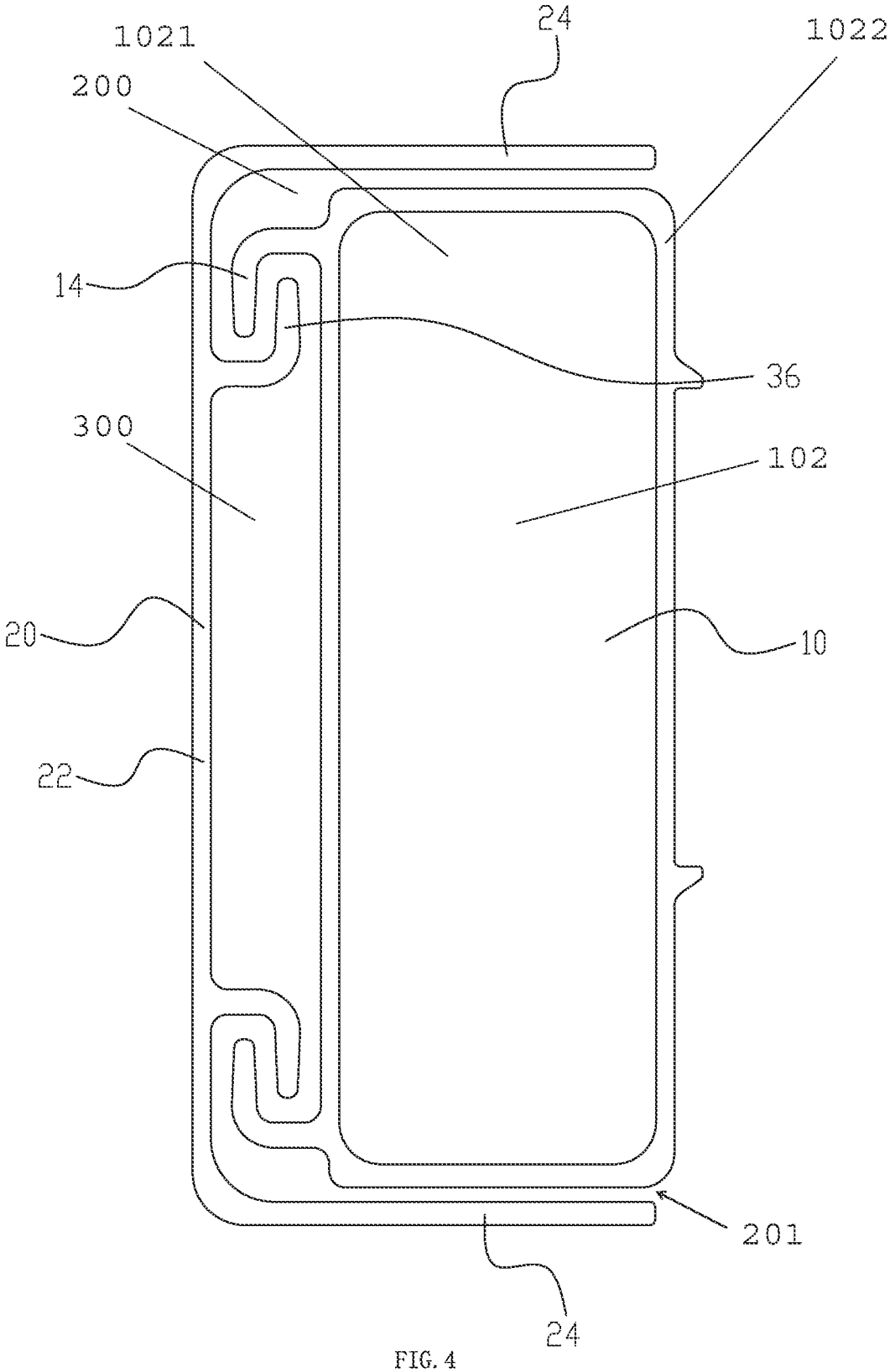
FIG. 4 illustrates a sectional diagram of a stretchable leg of a stretchable ladder of a third embodiment.

Referring to FIG. 4, this embodiment differs from the first embodiment in that: the lock structure comprises two lock hooks 36 disposed at the inner side of the bottom plate 22, the inner leg bar 10 is disposed with two curve hooks 14 corresponding to the two lock hooks 36, and the two lock hooks 36 are slidably locked to the two curve hooks 14. The two lock hooks 36 and the two curve hooks 14 are symmetrical. The outer leg bar 20 comprises the bottom plate 22 and two straight side plates 24, and the two straight side plates 24 are disposed on two ends of the bottom plate 22. The inner leg bar 10 comprises a closed frame 102. The two straight side plates 24 are parallel to and are separated from sides of the closed frame 102 adjacent to the two straight side plates 24. A first portion 1021 of the closed frame 102 adjacent to the bottom plate 22 is disposed in a frame 200 having an inner opening 201 defined by the bottom plate 22 and the two straight side plates 24, and a second portion 1022 of the closed frame 102 away from the bottom plate 22 extends out of the inner opening 201 of the frame 200 having the inner opening 201. A clearance 300 is defined between an outer side of the inner leg bar 10 and an inner side of the outer leg bar 20. The two lock hooks 36 are disposed on the inner side of the bottom plate 22 and are disposed in the clearance 300, and the two curve hooks 14 are disposed on an outer side of the closed frame 102 that is parallel to the inner side of the bottom plate 22 and are disposed in the clearance 300. The two lock hooks 36 are slidably locked to the two curve hooks 14 to enable the inner leg bar 10 to be configured to slide relative to the outer leg bar 20 along a length direction of the outer leg bar 20 and prevent the inner leg bar 10 from separating from the outer leg bar 20. An inner cross bar 40 (see FIG. 1) is fixed on an inner side of the closed frame 102, and the outer side of the closed frame 102 is parallel to the inner side of the closed frame 102.

INDUSTRIAL APPLICABILITY

The present invention is provided that the leg tube of the stretchable ladder is disposed with a lock structure, making the slidable connecting of the inner leg and the outer leg, the present invention has strong strength and simple structure.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A retractable ladder, comprising:

an inner leg bar, and an outer leg bar, wherein:

the inner leg bar comprises a closed frame, the outer leg bar comprises a bottom plate and two straight side plates, the two straight side plates are disposed on two ends of the bottom plate, the two straight side plates are parallel to and are separated from sides of the closed frame adjacent to the two straight side plates, a first portion of the closed frame adjacent to the bottom plate is disposed in a frame having an inner opening defined by the bottom plate and the two straight side plates, a second portion of the closed frame away from the bottom plate extends out of the inner opening of the frame having the inner opening, a clearance is defined between an outer side of the inner leg bar and an inner side of the outer leg bar, at least one lock hook is disposed on an inner side of the bottom plate and is disposed in the clearance, at least one curve hook is disposed on an outer side of the closed frame that is parallel to the inner side of the bottom plate and is disposed in the clearance, the at least one lock hook is slidably locked to the at least one curve hook to enable the inner leg bar to be configured to slide relative to the outer leg bar along a length direction of the outer leg bar and prevent the inner leg bar from separating from the outer leg bar, an inner cross bar is fixed on an inner side of the closed frame, and the outer side of the closed frame is parallel to the inner side of the closed frame.

2. The retractable ladder according to claim 1, wherein:

the at least one lock hook and the outer leg bar are integrally formed, and the inner leg bar is a closed hollow tube.

3. The retractable ladder according to claim 1, wherein an axis of the outer leg bar perpendicular to a cross section of the outer leg bar is parallel to an axis of the inner leg bar perpendicular to a cross section of the inner leg bar.

4. The retractable ladder according to claim 1, wherein the frame having the inner opening defines a hollow rectangular column comprising the inner opening.

5. The retractable ladder according to claim 4, wherein the inner cross bar is fixed on the second portion of the closed frame.

6. The retractable ladder according to claim 4, wherein an outer cross bar is fixed on the outer leg bar.

7. The retractable ladder according to claim 1, wherein the at least one lock hook and the at least one curve hook are disposed between the two straight side plates.

8. The retractable ladder according to claim 1, wherein the at least one lock hook consists of two lock hooks.

9. The retractable ladder according to claim 1, wherein:

the at least one lock hook defines a first L-shaped structure, and the at least one curve hook defines a second L-shaped structure.

10. The retractable ladder according to claim 1, wherein the at least one lock hook and the at least one curve hook define a lock structure between the inner leg bar and the outer leg bar configured to prevent the inner leg bar from being separated from the outer leg bar.

* * * * *